US005380122A

United States Patent [19]

Rambo et al.

[11] Patent Number: 5,380,122

[45] Date of Patent: Jan. 10, 1995

[54] JOINT FORMS FOR CONCRETE SLABS AND METHOD FOR INSTALLATION OF JOINT FORMS

[75] Inventors: Todd A. Rambo, Powder Springs, Ga.; G. P. Trigg, Farmers Branch, Tex.

[73] Assignee: BoMetals, Inc., Marietta, Ga.

[21] Appl. No.: 127,830

[22] Filed: Sep. 28, 1993

[51] Int. Cl.[6] ..... E01C 11/02

[52] U.S. Cl. ..... 404/47; 404/48; 404/49; 404/50

[58] Field of Search ..... 404/47, 48, 49, 50, 404/51, 68, 74; 40/606, 607, 612, 645; 256/13.1, 65; 403/240, 263, 395

[56] References Cited

U.S. PATENT DOCUMENTS

| | | | |
|---|---|---|---|
| Re. 24,921 | 1/1961 | Wilbur et al. . | |
| 1,345,179 | 6/1920 | Heltzel . | |
| 1,753,316 | 4/1930 | Robertson . | |
| 1,831,613 | 11/1931 | Symons . | |
| 2,848,929 | 8/1958 | Wilbur . | |
| 3,288,042 | 11/1966 | Gaetke . | |
| 3,300,920 | 1/1967 | Skaare . | |
| 3,357,324 | 12/1967 | Tone et al. . | |
| 3,401,612 | 9/1968 | Tone . | |
| 3,429,241 | 2/1969 | Burton . | |
| 3,497,172 | 2/1970 | Welch . | |
| 3,561,721 | 2/1971 | Self . | |
| 3,572,225 | 3/1971 | Burton . | |
| 3,628,764 | 12/1971 | Burton . | |
| 3,665,778 | 5/1972 | Bohan et al. . | |
| 3,770,237 | 11/1973 | Burton . | |
| 3,784,313 | 1/1974 | Collier, Jr. . | |
| 4,012,024 | 3/1977 | Courtois | 249/9 |
| 4,012,159 | 3/1977 | Berry | 404/68 |
| 4,127,352 | 11/1978 | Peters | 404/74 |
| 4,411,404 | 10/1983 | Weisbach | 249/3 |
| 4,455,104 | 6/1984 | Weisbach | 404/50 |
| 4,516,875 | 5/1985 | Turner | 404/50 |

OTHER PUBLICATIONS

Excerpt from *ACI Materials Journal*, May-Jun. 1989, pp. 257 and 258.

Brochure for Amico, "Screed Joint," (4 pages) (undated).

Brochure for BoMetals, Inc., "QuicKey," (2 pages) (Feb. 1992).

Brochure for BoMetals, Inc., "Pro-Key," (2 pages) (Nov. 1991).

Portion of brochure for Burke, "Keyed Kold Joint," p. 68, (undated).

Brochure for Chapman Industries, Inc., "Labor Saving 'Snaplock' Screed and Center Strip," (2 pages), (undated).

Tech Manual for Chapman, "'Snaplock' Screed and Anchor Slot," (6 pages) (undated).

Brochure for CSI, "Concrete Screed and 'Twinlock' Universal Stakes," (2 pages) (undated) (best available copy).

Brochure for Form-A-Key Products Div., "Key--Deck TM Joint System," (2 pages) (undated).

Brochure for Form-A-Key Products Div., "Key--Loc ® Joint System," (4 pages) (undated).

Brochure for Form-A-Key Products Div., "Key-Loc Plus TM ," (2 pages) (undated).

Installation information for Form-A-Key Products Div., "Key-Loc Plus TM ," (6 pages) (undated).

Brochure for Form-A-Key Products Division, "Key--Loc Plus TM Installation."

(List continued on next page.)

*Primary Examiner*—Ramon S. Britts
*Assistant Examiner*—Pamela A. O'Connor
*Attorney, Agent, or Firm*—Kilpatrick & Cody

[57] ABSTRACT

Joint forms for use in concrete slab formation. Such joint forms may be locked vertically and, if desired, laterally onto joint forms stakes by virtue of a number of aligned stake ear slots 26 and locking slots 28 which cooperate with corresponding ears and locking tabs on the stakes. The joint forms may include a number of stake retention slots aligned with the stake ear slots and locking slots, so that the stakes may be passed through portions of the joint forms in order to lock the forms laterally to the stakes as well as vertically so as not to separate from the stakes during concrete pouring.

23 Claims, 5 Drawing Sheets

OTHER PUBLICATIONS

Installation information for KeyKold, Inc., "Form-A-Key," (4 pages) (undated) (best available copy).

Brochure for Form-A-Key products Div., "Form-A-Key Products Introduces . . . 'Stay-in-Place' Plastic Cap," (1 page), (undated).

Brochure for Form-Rite®, "Screed Key TM," (4 pages) (undated).

Brochure for A. C. Horn, Inc., "Dura-Screed," (1 page) (undated).

Portion of brochure for Hughes Manufacturing, Inc., "Metal Screed Joint & Stakes," p. 14, (undated).

Installation Guide for Permaban® Screed Rails, Permaban North America, Inc., 1987 (4 pages).

Brochure for Superior Concrete Accessories, Inc., "Screed & Load Key Joints," Aug. 1980, (8 pages).

Brochure with handwritten notation "Dayton/-Superior," Miscellaneous Accessories, (1 page) (undated).

Brochure for Universal Accessories, Inc., "Uni-Key Screed," Apr. 1992 (4 pages).

Brochure for Universal Form Clamp Co., "Uni-Key Joint," appears to be Jan. 1992 (2 pages) (best available copy).

Installation brochure for Vulcan Metal Products, "Screed Joint," (6 pages) (undated).

Fact Sheet with handwritten notations "Form-A-Key World of Concrete Jan. 1990," (1 page).

Excerpt from Supplementary Seminar Reading from Aberdeen's World of Concrete® '92 USA, Feb. 16-20, 1992, "Joints in Concrete," (cover sheet and p. 33).

JOINT FORMS FOR CONCRETE SLABS AND METHOD FOR INSTALLATION OF JOINT FORMS

This invention relates to joint forms for use in the formation of concrete slabs.

BACKGROUND OF THE INVENTION

Concrete slabs may be formed in various ways. Wooden boards have long been used in forming sidewalks, driveways, and footings for dwellings, for example. Deformation of wood due to heat and moisture, and the ever-increasing need for greater precision in dimensioning and leveling concrete slabs has, however, escalated the use of metal forms. Apart from being more dimensionally stable and controllable, metal forms may be manufactured with channels which allow one slab to feature a "key" that projects into the formed channel in an adjacent slab. Such joints are known as keyed joints, and are important in limiting movement of adjacent slabs with respect to each other.

Various techniques have been employed for connecting metal joint forms to the stakes which fasten the forms to the ground or other underlying substrate. U.S. Pat. No. 4,455,104 to Weisbach, for example, discloses a form whose top edge and cross section is folded over to form a downturned flange that has its lower edge hemmed on the inside to capture vertical rows of serrations on metal stakes which fasten the form to the substrate. U.S. Pat. No. 3,784,313 to Collier also features a form with folded over upper edge that captures protrusions on stakes.

Other designs exist which assist in retaining the form on the stakes. For instance, U.S. Pat. No. 3,561,721 to Self shows a joint form that includes periodic openings which receive ears that have been formed in the upper portions of the stakes by punching or cutting and bending. Barb members on such ears assist in helping retain the form on the stakes. These three patents by Weisbach, Collier, and Self are incorporated herein by this reference.

SUMMARY OF THE INVENTION

Joint forms according to the present invention include a number of substantially aligned pairs of stake ear slots and locking slots which receive, respectively, ears and locking tabs formed in the upper portions of retaining stakes in order to lock the stakes to the forms. In an alternative embodiment, the forms also include a number of stake retention slots, each of which is aligned with a stake ear slot and a locking slot. The stakes may accordingly be passed through the retention slots so that their ears and tabs, respectively, may be captured in the stake ear slots and stake retention slots. This alternative not only allows the stakes to be locked in vertical fashion to the form, but also locked to the form laterally in an expedient fashion so that lower portions of the form do not move away from the stake when concrete is poured. The locking slots and stake retention slots may be formed to correspond to the cross section of the stakes, in order to prevent inadvertent incorrect orientation of the stakes. The stake retention slots may also be utilized with the form lying flat on the ground or otherwise suitably positioned, to place the stakes in the substrate, and thus as an automatic alignment feature.

It is accordingly an object of the present invention to provide a joint form which may be inexpensively and reliably manufactured in a precise and uniform manner to lock vertically, and, if desired, laterally to joint form stakes quickly, easily, without special tools, and/or removably.

It is an additional object of the present invention to provide a joint form which may be locked vertically to joint form stakes, but in a manner in which the form may be easily disengaged from the locking relationship with the stakes.

It is an additional object of the present invention to provide a joint form which may be vertically and laterally locked to joint form stakes simply, and with a reduced margin of error.

It is an additional object of the present invention to provide a joint form which may serve as an alignment tool for positioning of stakes in the substrate.

Other objects, features and advantages of the present invention will become apparent with respect to the remainder of this document.

DETAILED DESCRIPTION OF THE DRAWINGS

Figure 1:
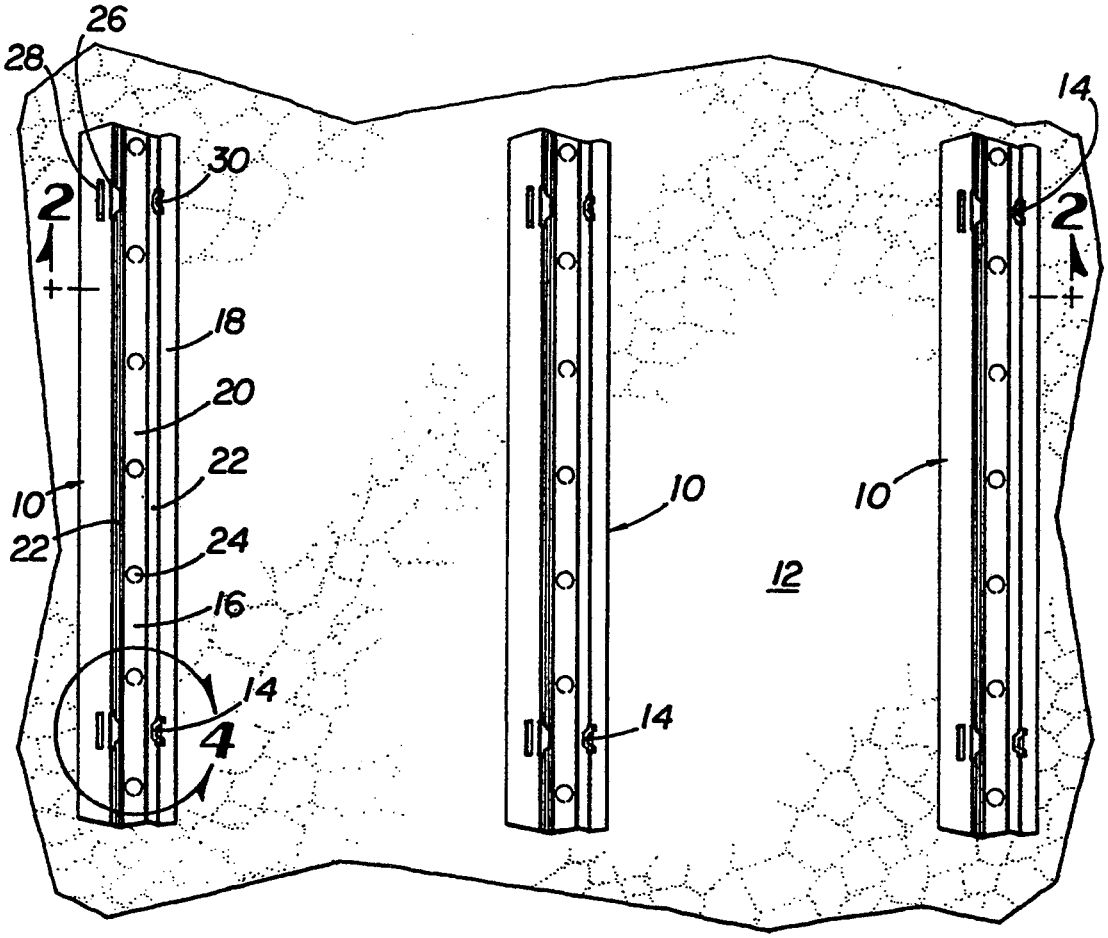
FIG. 1 is a plan view of a plurality of joint forms of the present invention positioned on the substrate in order to align and place stakes.

FIG. 1 shows three joint forms 10 according to a first embodiment of the present invention positioned on substrate 12 in a manner that allows a number of stakes 14 to be aligned with each other and the joint forms 10 and placed in the substrate 12. Joint forms 10 and stakes 14 may be formed of conventional metals using conventional joint form rolling, stamping, cutting and other manufacturing processes.

Each joint form 10 in the embodiment shown in FIG. 1, and as shown more closely in FIG. 4 and FIGS. 7–9, preferably includes a channel 16 that abuts at least one, but preferably a pair of facing portions 18 which are vertical surfaces when the joint form is positioned for pouring concrete. The channel 16 as shown in FIGS. 1, 4 and 7–9, features a flat bottom 20 and oblique angled sides 22 which meet facing portions 18. The bottoms 20 and angled sides 22 may be shaped and oriented as otherwise desired in order to form the key of one slab and the corresponding indentation in the adjacent slab. Channels 16 may also contain knock-out holes 24 which may be punched out for placement of rebar or other structure that will be used to reinforce concrete slabs formed by the joint forms 10.

As shown in FIG. 1, but more closely in FIGS. 4 and 7–9, each joint form according to the first embodiment of the invention contains a number of stake ear slots 26 and a number of locking slots 28. The stake ear slots 26 may be formed by cutting, punching or as otherwise desired partially in the channel 16 and partially in the facing portions 18, or as otherwise desired in order to capture ears of stakes 14 as discussed below. The locking slots 28 may be formed in facing portions 18 as desired and in any shape desired to capture tabs of stakes 14 effectively and efficiently as discussed below.

In addition to stake ear slots 26 and locking slots 28, the joint forms 10 of FIGS. 1–9 also contain a number of stake retention slots 30 which are formed in joint form 10 substantially aligned laterally of joint form 10 with corresponding stake ear slots 26 and locking slots 28. The stake retention slots may be formed partially in the channels 16 and in facing portions 18, or as otherwise desired. In the embodiment shown in FIG. 1, stake retention slots 30 are formed to conform to the cross section of stakes 14 so that the stakes 14 may be inserted into joint form 10 in only one orientation.

Figure 2:
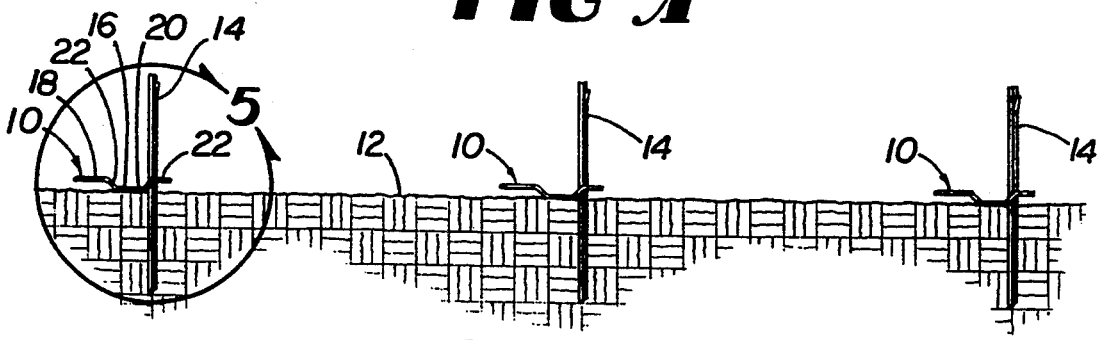
FIG. 2 is a cross-sectional view of the joint forms of FIG. 1 through which stakes have been placed in the substrate.
Figure 3:
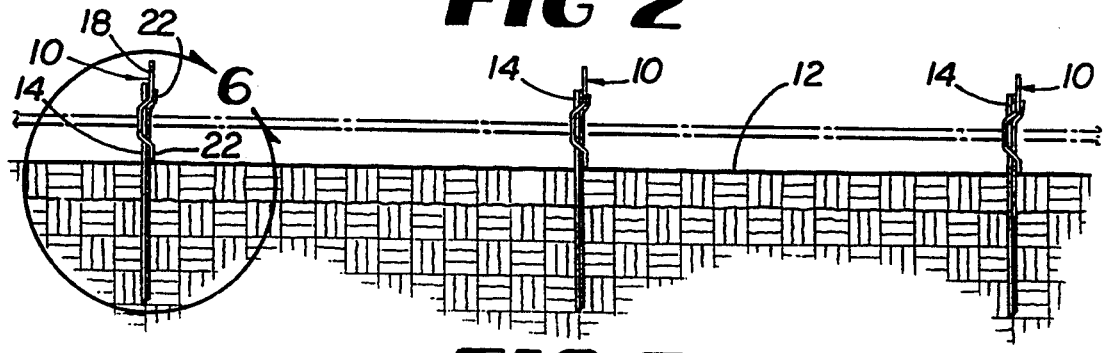
FIG. 3 is a cross-sectional view corresponding to FIG. 2 in which the joint forms have been positioned and locked onto the stakes.
Figure 4:
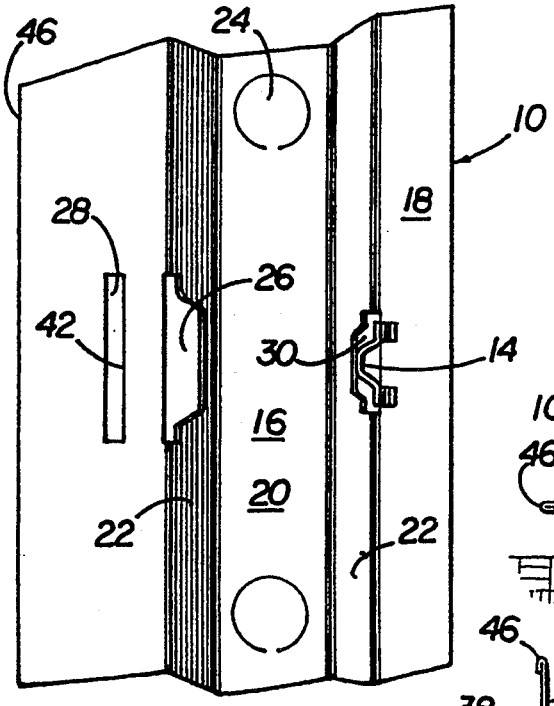
FIG. 4 is a closer plan view of a portion of a joint form as shown in FIG. 1.
Figure 5:
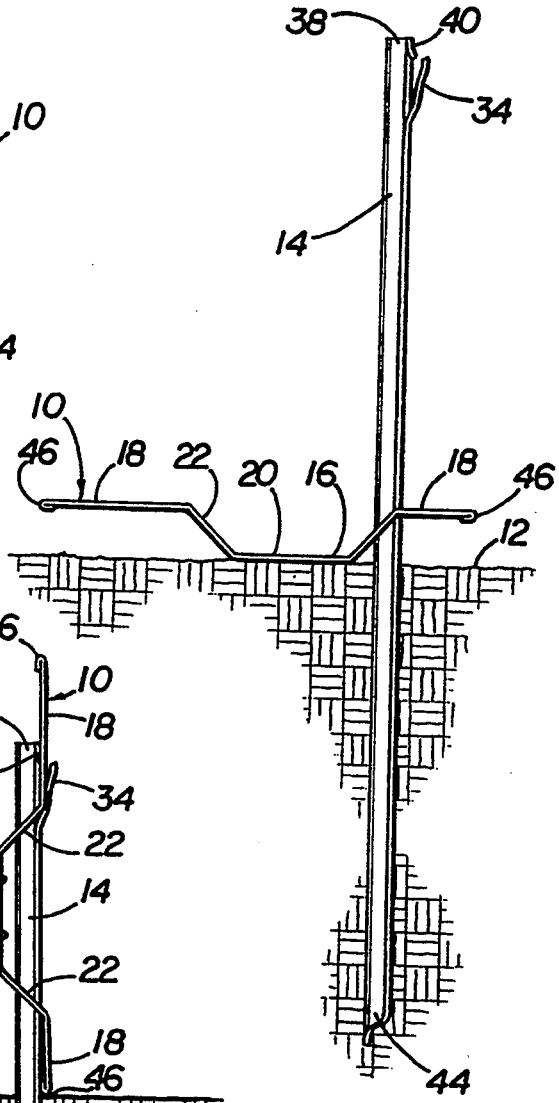
FIG. 5 is a detailed view of the joint form and stake as shown in FIG. 2.
Figure 6:
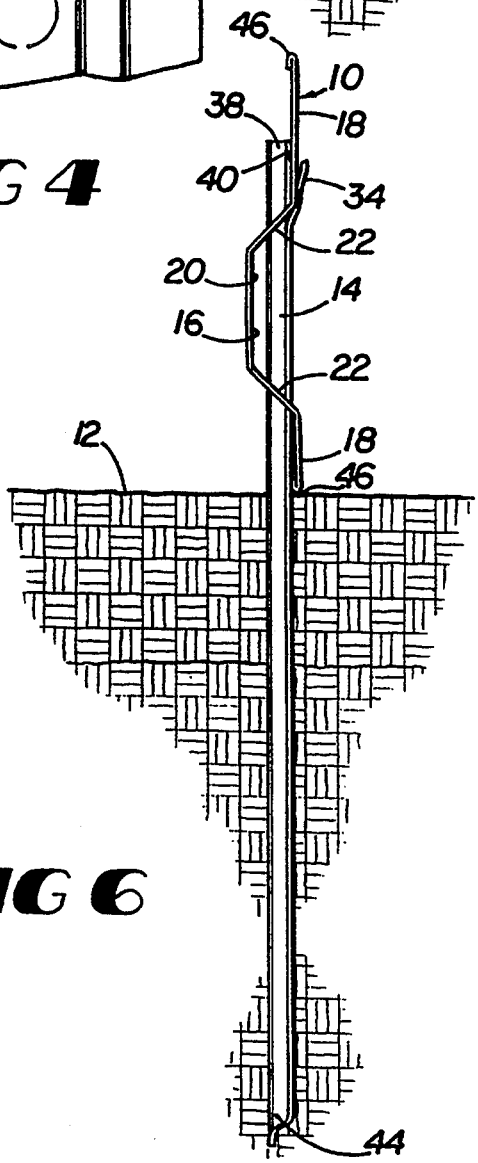
FIG. 6 is a detailed view of the joint form and stake shown in FIG. 3.

FIG. 2 shows more clearly stakes 14 placed in substrate 12 through joint form 10, including the convenient alignment of such stakes 14 by virtue of using the stake retention slots 30 in the joint form 10 for alignment purposes. As shown in FIGS. 2 and 3, the joint form 10 may be then positioned up and over the upper portions of stakes 14 in order to lock joint forms 10 vertically onto the stakes 14 for pouring concrete. FIGS. 5 and 6 show this positioning in greater detail.

Figure 7:
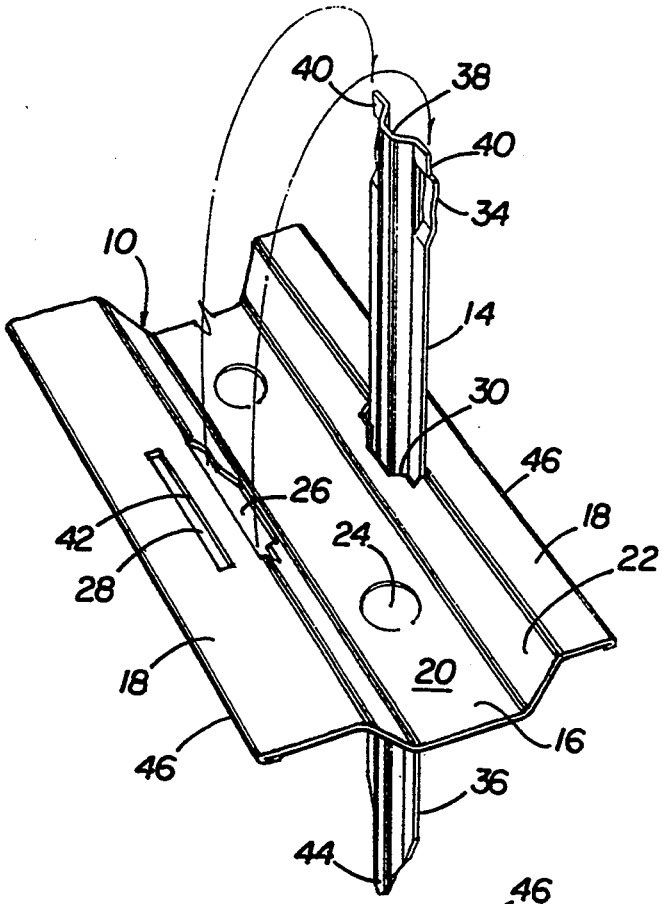
FIG. 7 is a perspective view of a joint form and stake as shown in FIG. 1, and the manner in which the form may be positioned to lock onto the stake.
Figure 8:
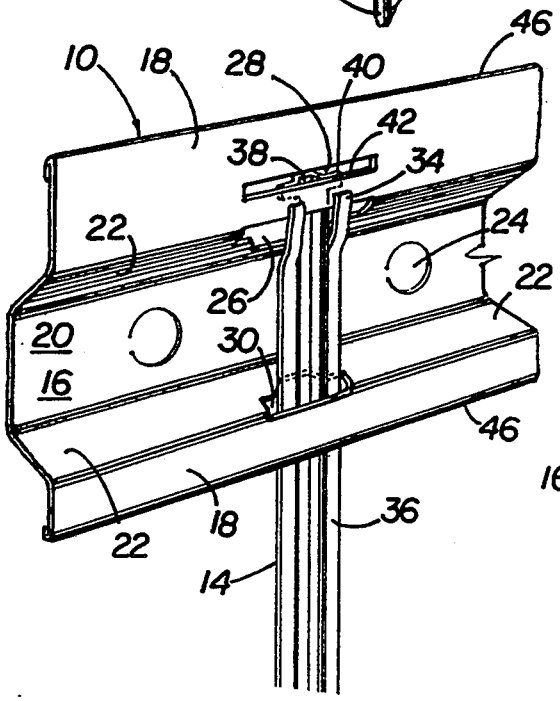
FIG. 8 is a perspective view showing the joint form being positioned onto the stake.
Figure 9:
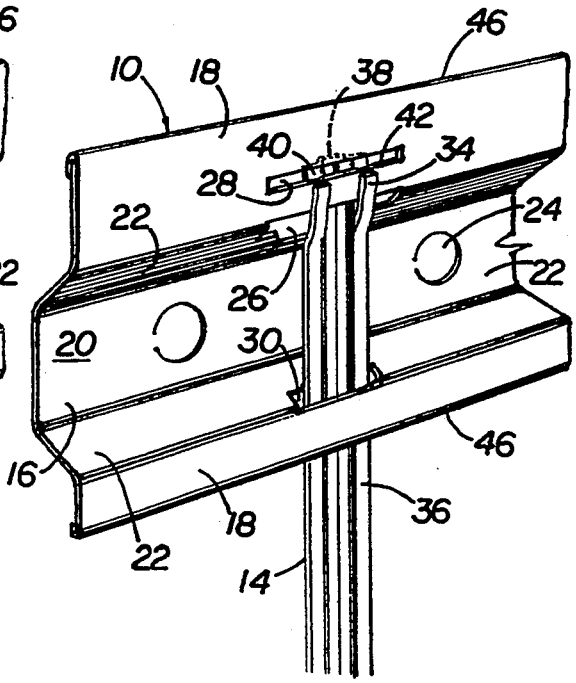
FIG. 9 is a perspective view of the joint form of FIG. 8 locked onto the stake.
Figure 10:
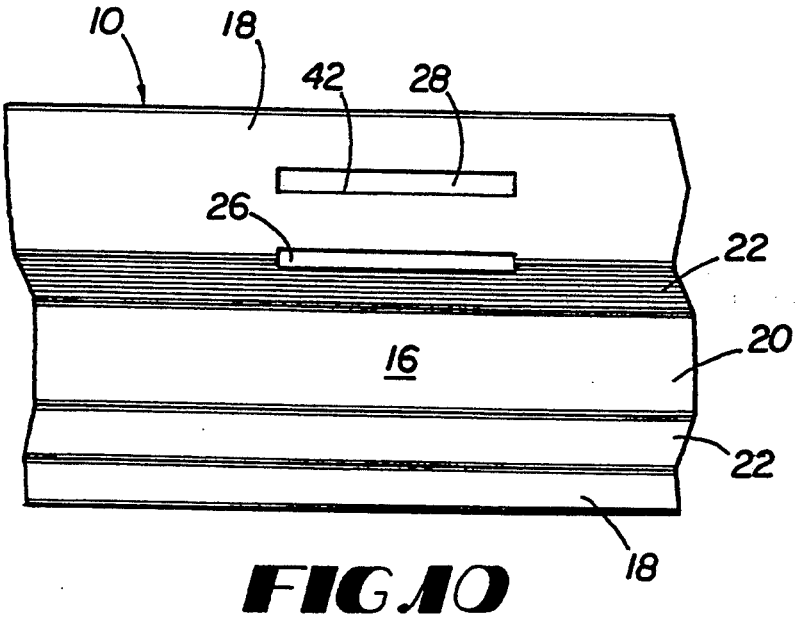
FIG. 10 is a plan view of a second embodiment of a joint form according to the present invention that contains no stake retention slots.
Figure 11:
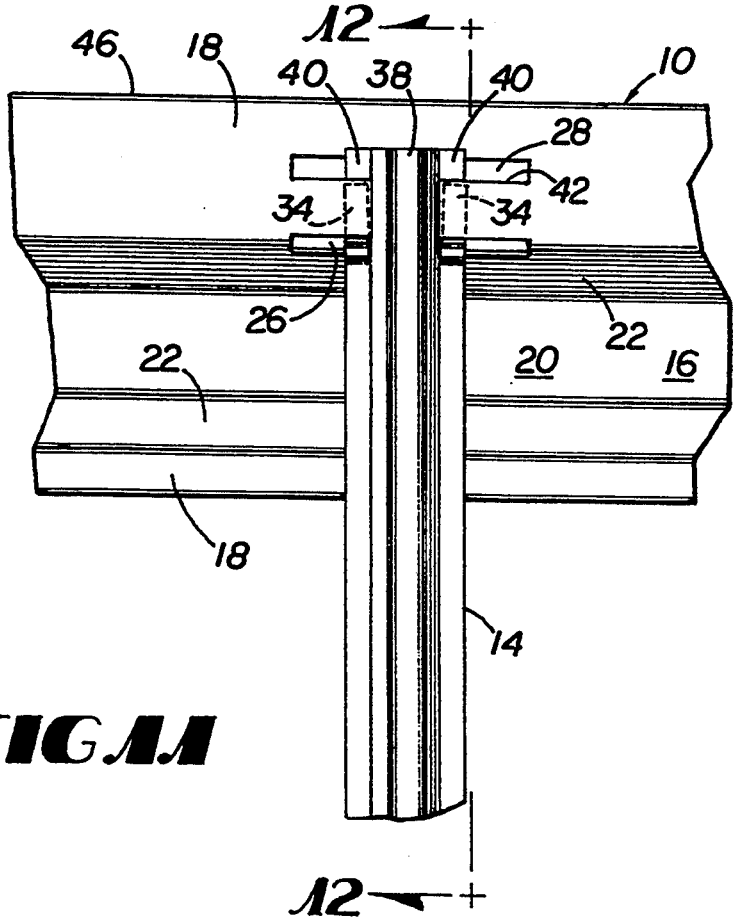
FIG. 11 is a plan view of the joint form of FIG. 10 showing an attached, locked stake.
Figure 12:
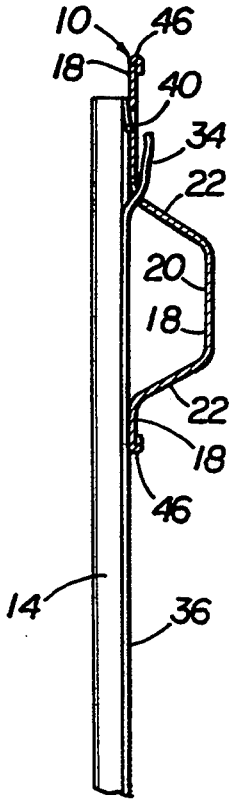
FIG. 12 is a side view of the joint form and stake of FIG. 11.
Figure 13:
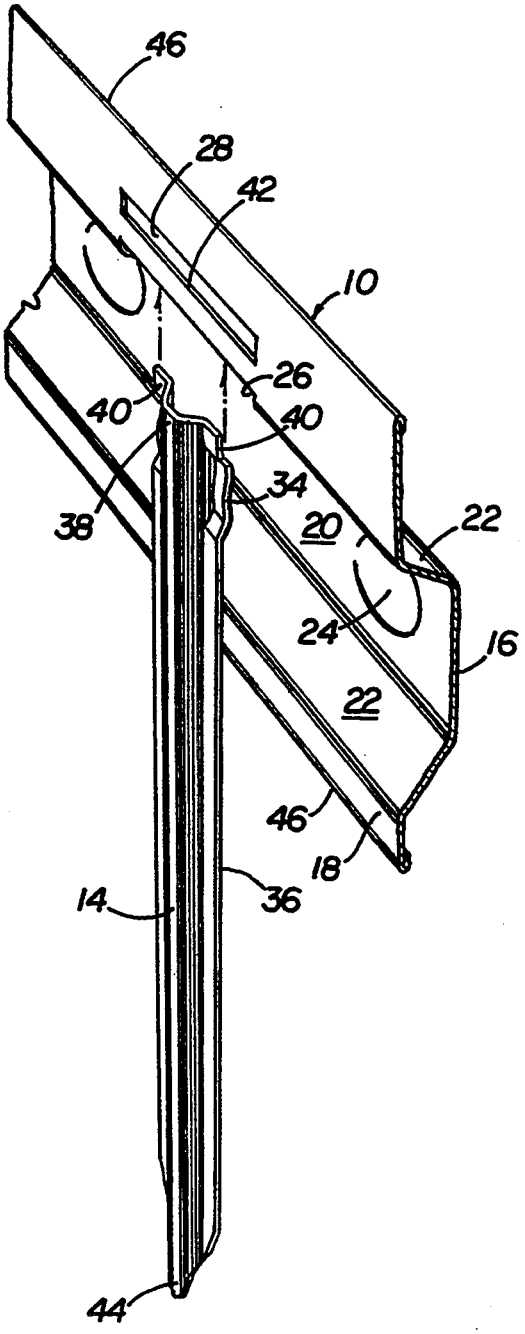
FIG. 13 is a perspective view of the embodiment shown in FIG. 11, in which the form is being positioned onto the stake.
Figure 14:
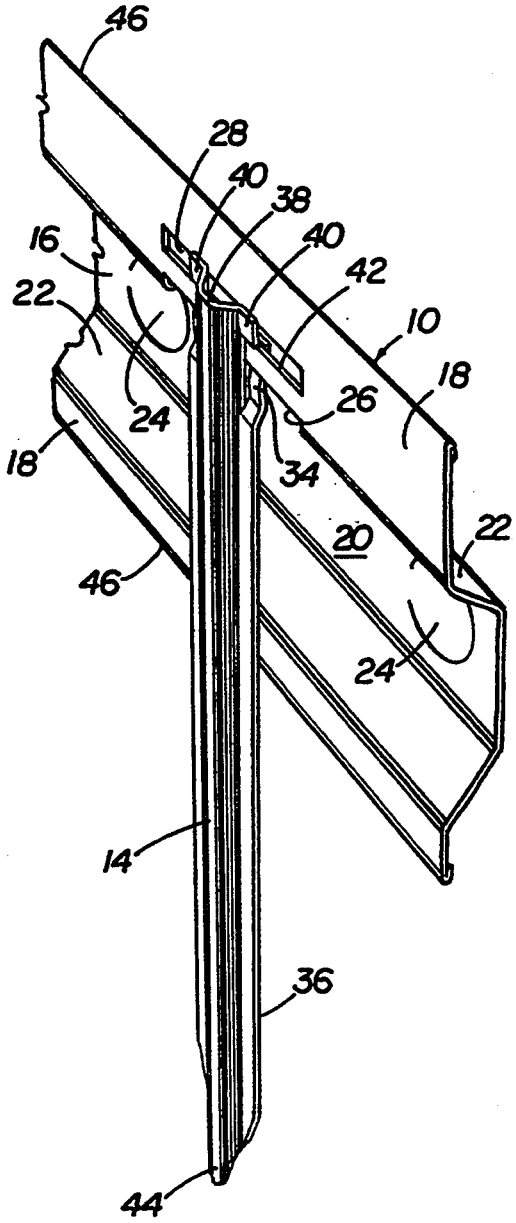
FIG. 14 is a perspective view of the joint form of FIG. 11 in which the form has been locked onto the stake.

FIGS. 7–9 show more clearly the structure of stakes 14 which may be utilized according to the present invention. Such stakes 14 include at least one ear 34 which may be punched or cut and then bent into place, chiefly substantially parallel to the longitudinal axis of the stake 14, to extend through a stake ear slot 26 and retain the facing portion 18 of joint form 10 against the screed surface 36 (or side that faces joint form 10) of stake 14. Such ears are conventional in stake structure, as disclosed, for instance, in U.S. Pat. No. 3,561,721 issued Feb. 9, 1971 to Self.

The screed connection end (or upper end) 38 of stake 14 also contains at least one locking tab 40, preferably (but not necessarily) in its upper most portions. The locking tabs 40 of the stakes 14 shown in FIGS. 7–9 are simply tabs left after formation of ears 34 and then bent or otherwise properly formed so that their edges may capture an edge 42 of locking slot The capture may occur in a removable, easily disengaging fashion, or otherwise.

The tabs 40 shown in the stakes 14 of FIGS. 7–9 are formed in the distal portions of screed connection end 38 of stake 14, farthest away from penetration end 44 of the stakes. As mentioned above, however, locking tabs 40 could be positioned anywhere else along the length of stakes 14 as desired to capture any other portion of joint form 10, most preferably an opening in a facing portion 18.

Joint form 10 preferably has rolled edges 46 for dimensional stability and for precise manufacturing control in order to assure straightness and, consequently, level concrete surfaces.

The embodiments of joint forms 10 shown in FIGS. 1–9 need not be utilized with stakes 14 penetrating stake retention slots 30. They may just as easily be used without stakes 14 penetrating either stake retention slots 30 or stake ear slots 26. Then, screed surface 36 of stakes 14 abut the non-channel sides of facing portions 18 so that the ears 34 penetrate stake ear slots 26 from that side and locking tabs 40 also capture the locking slots 28 edges 42 on the non-channel side.

FIGS. 10–14 show an embodiment in which stakes 14 may be used as discussed immediately above without their body penetrating joint form 10 openings. There, joint form 10 is manufactured as described above with channel 16 and facing portions 18 (one or more), together with edges 46. However, only stake ear slots 26 and locking slots 28 are used, without stake retention slots 30. In this embodiment, the stake ear slots 26 need not contain a portion for penetration of the entire stake 14 cross section, but merely a slot of sufficient width to allow passage of ears 34 of stakes 14. The stake ear slots 26 and locking slots 28 may be spaced and dimensioned as appropriate to capture ears 34 and locking tabs 40 of stakes 14. This locking is shown more clearly in FIGS. 12–14.

Joint forms 10 and stakes 14 as shown in FIGS. 1–9 may be installed according to the present invention by aligning stakes 14 in stake retention slots 30 of joint forms 10, and placing them in substrate 12 to a suitable height. Joint form 10 may then be positioned onto to stakes 14 so that ears 34 fit within stake ear slots 26 and locking tabs 40 lock into locking slots 28. Similarly, the embodiment shown in FIGS. 10–14 includes a form 10 which may be installed by placing stakes 14 conventionally or as otherwise desired and locking ears 34 and tabs 40 of stakes 14 into ear slots 26 and locking slots 28, respectively, of form 10.

The foregoing is provided for purposes of explanation, illustration and description of embodiments of the invention. Modifications may be made to structures of the disclosure without departure from the scope or spirit of the invention.

What is claimed is:

1. A joint form unit for concrete slabs, comprising:

(a) an elongated screed which includes:

a key channel that extends substantially longitudinally in the screed;

at least one facing portion which extends substantially longitudinally in the screed and is connected to the key channel;

a plurality of stake ear slots formed in the screed, each for receiving at least one ear of a stake;

a plurality of locking slots formed in the facing and substantially aligned laterally of the screed with the stake ear slots, each for receiving at least one locking tab of a stake;

(b) a plurality of stakes connected to the screed, each comprising:

an elongated body having a penetrating end and a screed connection end;

at least one ear formed in the screed connection end and inserted into a stake ear slot in the screed; and at least one locking tab formed in the screed connection end, a portion of which is captured in a locking slot in the screed.

2. A joint form according to claim 1 in which at least one stake includes a screed surface and two ears, portions of which ears are cut from the stake and bent to extend from the screed surface in order to extend through an ear slot in the screed.

3. A joint form according to claim 1 in which at least one stake includes two locking tabs which form distal portions of the screed connection end, and which are bent to capture an edge of a screed locking slot.

4. A joint form according to claim 1 in which the ear slots of the screed are formed partially in the channel and partially in the facing.

5. A joint form according to claim 1 in which the ear slots of the screed are formed in the facing.

6. A joint form according to claim 1 in which the screed comprises two facing portions, on opposite sides of the channel.

7. A joint form for concrete slabs, comprising an elongated screed which includes:

a key channel that extends substantially longitudinally in the screed;

at least one facing portion which extends substantially longitudinally in the screed and is connected to the key channel;

a plurality of stake retention slots formed at least partially in the channel, each adapted to allow penetration of a stake;

a plurality of stake ear slots formed in the screed and substantially aligned laterally of the screed with the stake retention slots, each adapted to receive at least one ear of a stake; and a plurality of locking slots formed in the facing and substantially aligned laterally of the screed with the stake ear and stake retention slots, each adapted to receive at least one locking tab of a stake; the channel accordingly being adapted to receive a plurality of stakes in locking fashion using at least the corresponding stake ear slots and locking slots.

8. A joint form according to claim 7 in which the stake retention slots are shaped to correspond to the cross section of the stakes, so that the stakes may be inserted into the stake retention slots in only one orientation.

9. A joint form according to claim 7 in which the stake retention slots and stake ear slots are formed partially in the channel and partially in the facing.

10. A joint form according to claim 7 in which the stake retention slots and stake ear slots are formed in the channel.

11. A joint form according to claim 7 in which the screed comprises two facing portions, on opposite sides of the channel.

12. A joint form unit for concrete slabs, comprising:

(a) an elongated screed which includes:

a key channel that extends substantially longitudinally in the screed;

at least one facing portion which extends substantially longitudinally in the screed and is connected to the key channel;

a plurality of stake retention slots formed at least partially in the channel, each adapted to allow penetration of a stake;

a plurality of stake ear slots formed in the screed and substantially aligned laterally of the screed with the stake retention slots, each adapted to receive at least one ear of a stake; and a plurality of locking slots formed in the facing and substantially aligned laterally of the screed with the stake ear and stake retention slots, each adapted to receive at least one locking tab of a stake; and (b) a plurality of stakes connected to the screed, each comprising:

an elongated body having a penetrating end and a screed connection end;

at least one ear formed in the screed connection end and inserted into a stake ear slot in the screed; and at least one locking tab formed in the screed connection end, a portion of which is captured in a locking slot in the screed.

13. A joint form unit according to claim 12 in which the stakes are inserted into the stake retention slots in the screed.

14. A joint form unit according to claim 12 in which the stake retention slots are shaped to correspond to the cross section of the stakes, so that the stakes may be inserted into the stake retention slots in only one orientation.

15. A joint form according to claim 12 in which the stake retention slots and stake ear slots are formed partially in the channel and partially in the facing.

16. A joint form according to claim 12 in which the stake retention slots and stake ear slots are formed in the channel.

17. A joint form according to claim 12 in which at least one stake includes a screed surface and two ears, portions of which ears are cut from the stake and bent to extend from the screed surface in order to extend through an ear slot in the screed.

18. A joint form according to claim 12 in which at least one stake includes two locking tabs which form distal portions of the screed connection end, and which are bent to capture an edge of a screed locking slot.

19. A joint form according to claim 12 in which the stake retention slots and stake ear slots are formed partially in the channel and partially in the facing.

20. A joint form according to claim 12 in which the stake retention slots and stake ear slots are formed in the channel.

21. A method for placing a joint form on a substrate, comprising the steps of:

(a) providing (1) a screed which includes a plurality of stake retention slots and (2) a plurality of stakes;

(b) placing the stakes, substantially in alignment, through the stake retention slots into the substrate; and (c) attaching the stakes to the screed.

22. A method according to claim 21 in which the screed includes a plurality of stake ear slots and a plurality of locking slots, the stakes each include at least one ear for insertion into a stake ear slot and at least one locking tab, a portion of which is adapted to be captured in a locking slot, and the step of attaching the stakes to the screed includes the step of positioning the screed to cause the stake ears to be inserted into the stake ear slots and the locking tabs to be captured in the locking slots.

23. A method according to claim 21 in which the stake retention slots correspond in shape to the cross section of the stakes, so that the stakes may be placed in the screed in only one orientation.

* * * * *

UNITED STATES PATENT AND TRADEMARK OFFICE

CERTIFICATE OF CORRECTION

PATENT NO. : 5,380,122

DATED : January 10, 1995

INVENTOR(S) : Rambo et al.

It is certified that error appears in the above-indentified patent and that said Letters Patent is hereby corrected as shown below:

Column 3, line 64, insert "28." after the word "slot"

Column 5, lines 41-43 should appear as follows:

adapted to receive at least one locking tab of a stake;
the channel accordingly being adapted to receive a Signed and Sealed this Fourth Day of April, 1995

*Attest:*

*Attesting Officer*

BRUCE LEHMAN

*Commissioner of Patents and Trademarks*